US007503337B1

(12) United States Patent
Morgan et al.

(10) Patent No.: US 7,503,337 B1
(45) Date of Patent: Mar. 17, 2009

(54) GRIP TIP ASSEMBLY FOR WALKING AIDS

(76) Inventors: Timothy A. Morgan, 1945-25th Ave., Rice Lake, WI (US) 54868; Emery Jensen, 423 Hatten Ave., Apt. 416, Rice Lake, WI (US) 54868

( * ) Notice: Subject to any disclaimer, the term of this patent is extended or adjusted under 35 U.S.C. 154(b) by 0 days.

(21) Appl. No.: 11/881,705

(22) Filed: Jul. 30, 2007

(51) Int. Cl.
*A61H 3/02* (2006.01)

(52) U.S. Cl. ..... 135/70; 135/80

(58) Field of Classification Search ..... 135/65, 135/70, 77, 78, 80, 81; 403/202, 185, 379.5; 280/819, 823; 294/24
See application file for complete search history.

(56) References Cited

U.S. PATENT DOCUMENTS

| | | | | | |
|---|---|---|---|---|---|
| 51,677 | A | * | 12/1865 | Allamby et al. | 294/61 |
| 250,531 | A | * | 12/1881 | Heckler | 135/80 |
| 616,738 | A | * | 12/1898 | Schwarting | 135/78 |
| 619,235 | A | * | 2/1899 | Schwarting | 135/80 |
| 862,455 | A | * | 8/1907 | Dunkel | 135/70 |
| 970,497 | A | * | 9/1910 | Harding | 135/70 |
| 2,371,246 | A | * | 3/1945 | McGrory et al. | 135/70 |
| 2,492,916 | A | * | 12/1949 | Chute et al. | 135/80 |
| 2,501,890 | A | * | 3/1950 | Desso, Sr. et al. | 135/70 |
| 3,448,749 | A | * | 6/1969 | Stark | 135/70 |
| 4,411,284 | A | * | 10/1983 | Opitz | 135/81 |
| 4,434,808 | A | * | 3/1984 | Burak | 135/80 |
| 4,964,430 | A | * | 10/1990 | Janis | 135/78 |
| 4,977,914 | A | * | 12/1990 | Smerker | 135/81 |
| 5,310,177 | A | * | 5/1994 | Conrad et al. | 473/133 |

* cited by examiner

*Primary Examiner*—David Dunn
*Assistant Examiner*—Patrick Lynch
(74) *Attorney, Agent, or Firm*—Thomas B. Tate

(57) ABSTRACT

A remotely adjustable grip tip assembly for a walking aid, such as a crutch, cane, or walking stick that has a hollow tubular structure. The assembly includes a rod extending vertically within the hollow tubular structure, slots formed into the hollow tubular structure near its top and bottom ends, an adjustment screw or pin fitting into each slot, a spring near the bottom end of the hollow tubular structure, and a moveable gripper foot at the bottom end of the hollow tubular structure.

6 Claims, 2 Drawing Sheets

GRIP TIP ASSEMBLY FOR WALKING AIDS

BACKGROUND OF THE INVENTION

The field of the invention is grip tip assemblies for walking aids.

People who have difficulty walking due to injury, illness, or age have long used canes, crutches, walking sticks, and similar devices to assist them. Certain circumstances, such as difficult terrain or bad weather, pose particular challenges in walking, even with the use of walking aids. No walking aids that are designed for these circumstances are known to be on the market. Walking aids with a gripper foot for walking in ice and snow have been proposed, as shown in the following U.S. Pat. No. 619,235 to Schwarting, No. 4,964,430 to Janis, No. 4,434,808 to Burak, and No. 4,411,284 to Opitz. However, none of these prior art patents shows a gripper foot that is remotely adjustable or is interchangeable for different types of terrain and weather.

SUMMARY OF THE INVENTION

The invention is a grip tip assembly for a walking aid.

An advantage of the invention is that it is remotely adjustable, that is, the mechanism for changing to a gripper foot from a normal crutch or cane is located within convenient reach so that the user can make the adjustment without having to lift the crutch or cane, and therefore can maintain three-point balance.

Another advantage of the invention is that it has interchangeable feet, so that it can be used not only in ice and snow but also, with the use of an alternative foot, for walking in sandy or marshy areas.

DETAILED DESCRIPTION OF THE INVENTION

Figure 1:
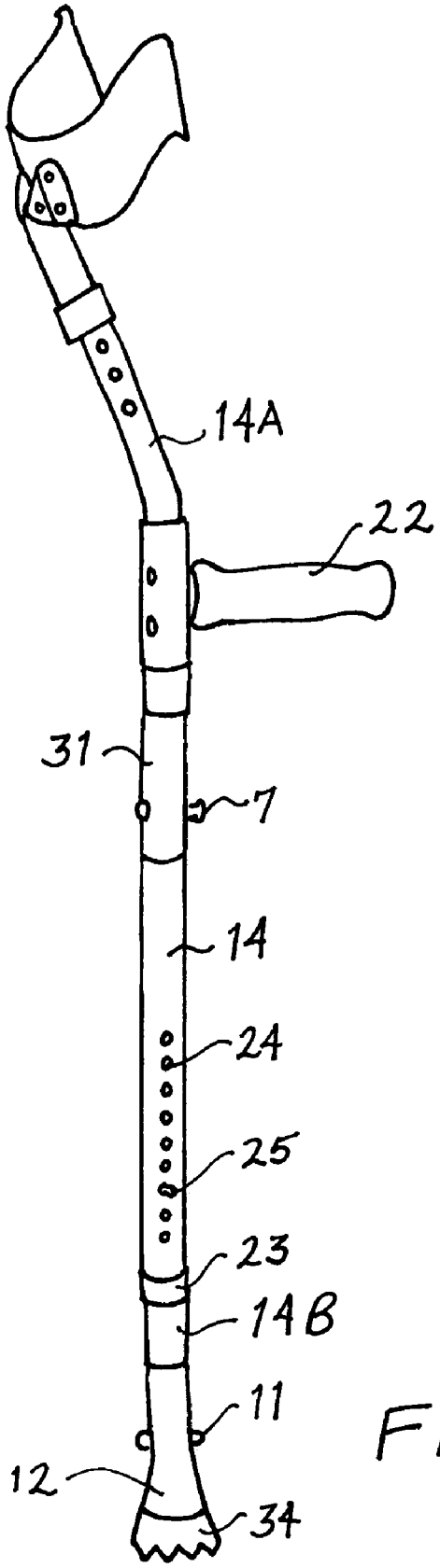
FIG. 1 is a front view of the exterior of the invention.
Figure 2:
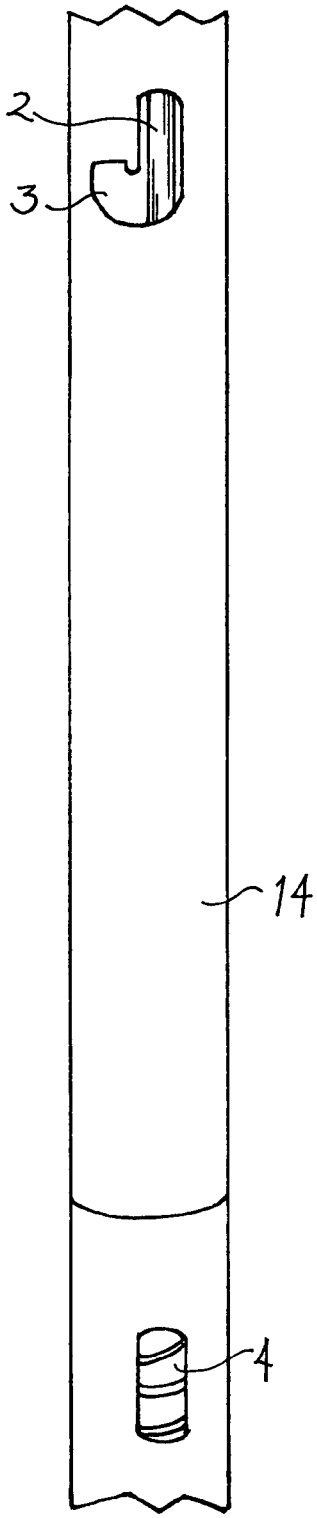
FIG. 2 is a side detail view with some exterior components removed in order to reveal the slots in the external hollow tube.
Figure 3:
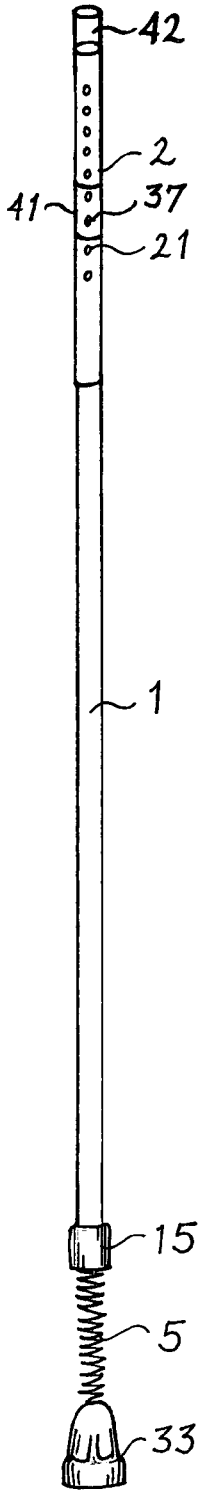
FIG. 3 is a side view of the internal components of the invention.
Figure 4:
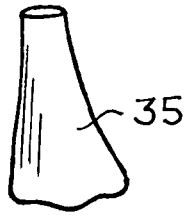
FIG. 4 is a front view of the duck foot that can be used interchangeably with the serrated foot shown in FIG. 1.

The invention is a remotely adjustable grip tip assembly for a walking aid, such as a crutch, cane, walking stick, or the like, that has a hollow tubular structure comprising an external hollow tube 14 and an internal hollow tube 2. The external hollow tube 14 is a two-part tube comprising a bottom part 14B that slides into the top part 14A, and is a standard component of the crutch. The grip tip assembly comprises a rod 1 disposed vertically within the internal hollow tube 2 of the walking aid, a first slot 3 formed into external hollow tube 14 near the top end of tube 14 and a second slot 4 formed into external hollow tube 14 near the bottom end of tube 14, a spring 5 disposed within hollow tube 14 near the bottom end of tube 14, a first adjustment means 7 disposed through the first slot 3 and a second adjustment means 11 disposed through the second slot 4, and a foot 12 formed at the bottom end of hollow tube 14, foot 12 surrounding the rubber foot 33 that is an integral part of the crutch.

The rod 1 is preferably made of solid metal. At its upper end the rod 1 inserts into the internal hollow tube 2, and pushes against a set screw or pin 37 which is inserted into one of a plurality of adjustment holes 21 formed into tube 2. A safety sleeve 41 fits over set screw or pin 37 to hold screw or pin 37 in the adjusted position. At its bottom end the rod 1 is threaded into a solid, generally cylindrical block or bushing 15. The internal hollow adjustment tube 2 is positioned in the central part of tube 14, from just below the point of attachment of handgrip 22 to the area where the collett ring 23 joins the upper and lower parts 14A and 14B, respectively, of external tube 14. The adjustment tube 2 has nine holes 21 corresponding to the conventional nine holes 24 in tube 14, with an adjustment pin 25 that can be inserted into different holes 24 to adjust the length of the walking aid to accommodate taller or shorter people.

The first slot 3 is formed into tube 14 near the upper end thereof, and is preferably a J-slot. A control sleeve 31 fits over the J-slot 3 and a bushing 42 fits over the top end of internal hollow tube 2. The first adjustment means 7, which can be a screw or a pin, is inserted through control sleeve 31, bushing 42, and internal hollow tube 2 into J-slot 3 and is held in place by the control sleeve 31, which ensures that the weight of the person using the walking aid is transferred to the control sleeve 31, bushing 42, and the screw 7. When the screw 7 is in the bottom part of the J-slot 3, the foot 12 is locked in the down position so that the gripper foot function can be used. When the screw 7 is riding at the top of the J-slot 3, the foot 12 is in the up position so that the conventional rubber foot 33 of the crutch or cane can be used. To make the adjustment, the person using the walking aid turns the control sleeve 31 approximately one-quarter turn or less, which causes pin 7 to move to the top of J-slot 3 by means of spring 5 using upward movement and the pressure of spring 5 to keep pin 7 and gripper foot 12 in the up position. To return to the use of gripper foot 12, the control sleeve 31 is rotated with downward pressure to its original position, which moves pin 7 downward to the bottom of J-slot 3 and locks pin 7 and foot 12 into position for use.

The second slot 4 is formed into tube 14 near the bottom end thereof, and is preferably a straight vertical slot. The second adjustment means 11, which may be a pin, a screw, or a small bolt, is inserted through a hole (not shown) in foot 12, vertical slot 4, and a hole (not shown) through bushing 15 and rod 1. The pin 11 rides up and down in vertical slot 4 to raise and lower the foot 12. Spring 5, which is attached to the bottom of bushing 15 and extends downward into the rubber foot 33 of the crutch or cane to the bottom of the rubber foot 33, maintains a constant tension to hold the gripper foot 12 in the up position when not in use.

The gripper foot 12 is a generally conical structure made of metal, preferably stainless steel, that is formed at the bottom end of tube 14, external to the conventional rubber foot 33 of the crutch or cane. The gripper foot 12 has interchangeable gripping structures. In the preferred embodiment, the foot 12 is threaded at the bottom of the conical part, and the gripper attachments are also threaded so that they can be interchanged easily as needed. However, other means of attachment could be used. The gripper attachment structure most commonly used is a generally circular structure having serrated teeth 34 of large and generally uniform size for gripping in ice and snow. The alternative gripper attachment structure, used for walking on sandy beaches, in marshes, and other soft terrain, is a duck foot structure 35 which is flat and wide instead of serrated, is somewhat elliptical and is slightly narrower on the inside (toward the person using the walking aid), to reduce sinking into soft ground.

The examples in the foregoing description of the preferred embodiments of the invention are offered by way of illustration of the best mode for carrying out the invention and not by way of limitation, the invention being limited only by the appended claims. It is intended that the scope of the invention include all equivalents that perform the same function in substantially the same way to achieve substantially the same result.

We claim:

1. A remotely adjustable grip tip assembly for a walking aid having a hollow tubular structure and a rubber foot, said assembly comprising:

a rod disposed vertically within said hollow tubular structure, the bottom end of said rod being inserted into a bushing;

a first slot formed into said hollow tubular structure near the top end thereof and a second slot formed into said hollow tubular structure near the bottom end thereof;

a first adjustment means disposed through said first slot and a second adjustment means disposed through said second slot;

a foot formed at the bottom end of said hollow tubular structure, said foot comprising a gripper foot structure external to said rubber foot of said walking aid;

spring means disposed within said hollow tubular structure near the bottom end thereof, said spring means extending from said bushing into said rubber foot of said walking aid;

a control sleeve fitted over said first slot, said control sleeve being rotatable to cause said first adjustment means to move upward or downward within said first slot and said second adjustment means to move upward or downward within said second slot in order to adjust the position of said gripper foot structure.

2. The grip tip assembly of claim 1 wherein said first slot is a J-slot.

3. The grip tip assembly of claim 1 wherein said second slot is a vertical slot.

4. The grip tip assembly of claim 1 wherein said first adjustment means is selected from a group that includes screws and pins and said second adjustment means is selected from a group that includes screws, pins, and bolts.

5. The grip tip assembly of claim 1 wherein said gripper foot has interchangeable gripping structures selected from a group that includes a gripper having serrated teeth for walking in ice and snow and a duck foot structure for walking on soft ground.

6. The grip tip assembly of claim 1 wherein said hollow tubular structure comprises an external hollow tube and an internal hollow tube, said rod being disposed within said internal hollow tube.

* * * * *